United States Patent [19]

Schutz

[11] 4,173,288

[45] Nov. 6, 1979

[54] PALLET CONTAINER

[76] Inventor: Udo Schutz, Rückersteg 4, D-5418 Selters, Fed. Rep. of Germany

[21] Appl. No.: 915,501

[22] Filed: Jun. 14, 1978

[51] Int. Cl.[2] ..... B65D 87/00; B65D 7/42

[52] U.S. Cl. ..... 220/1.5; 220/69; 220/462

[58] Field of Search .... 220/1.5, 5 R, 5 A, 69, 220/70, 402, 403, 85 B, 460, 461, 462, 463; 206/508

[56] References Cited

U.S. PATENT DOCUMENTS

| | | | |
|---|---|---|---|
| 2,457,842 | 1/1949 | Smith et al. | 220/1.5 |
| 2,648,428 | 8/1953 | White et al. | 220/69 X |
| 3,044,656 | 7/1962 | Combs et al. | 220/1.5 X |
| 3,117,692 | 1/1964 | Carpenter et al. | 206/508 X |
| 3,179,323 | 4/1965 | Miller | 220/462 |
| 3,695,471 | 10/1972 | Rivers, Jr. | 220/1.5 X |
| 3,828,964 | 8/1974 | Bonnot | 220/1.5 |

*Primary Examiner*—Steven M. Pollard
*Attorney, Agent, or Firm*—Young & Thompson

[57] ABSTRACT

A pallet container for the transport of liquids, comprises an inner container of synthetic resin supported at its lower, rounded edges on a correspondingly profiled ring of foamed plastic, e.g., styrofoam. The inner container is disposed in an outer shell of sheet metal with a bottom and a lid and with recesses to provide access to the filling and outlet openings of the inner container. The side walls of the sheet metal shell are prestretched between rounded corners of the shell to form supporting columns for stacked pallet containers. A steel tube pallet is welded to the bottom of the shell and comprises a lower tubular steel frame and an upper tubular steel frame welded together at the corners by profiled metal plates and in the middle of the straight sides by small supporting tubes. The outer sheet metal shell has upwardly and downwardly extending rims which receive respectively the lower and upper tubular steel frames of the pallet, the pallet being welded to the bottom of the container.

7 Claims, 5 Drawing Figures

PALLET CONTAINER

Figure 1:
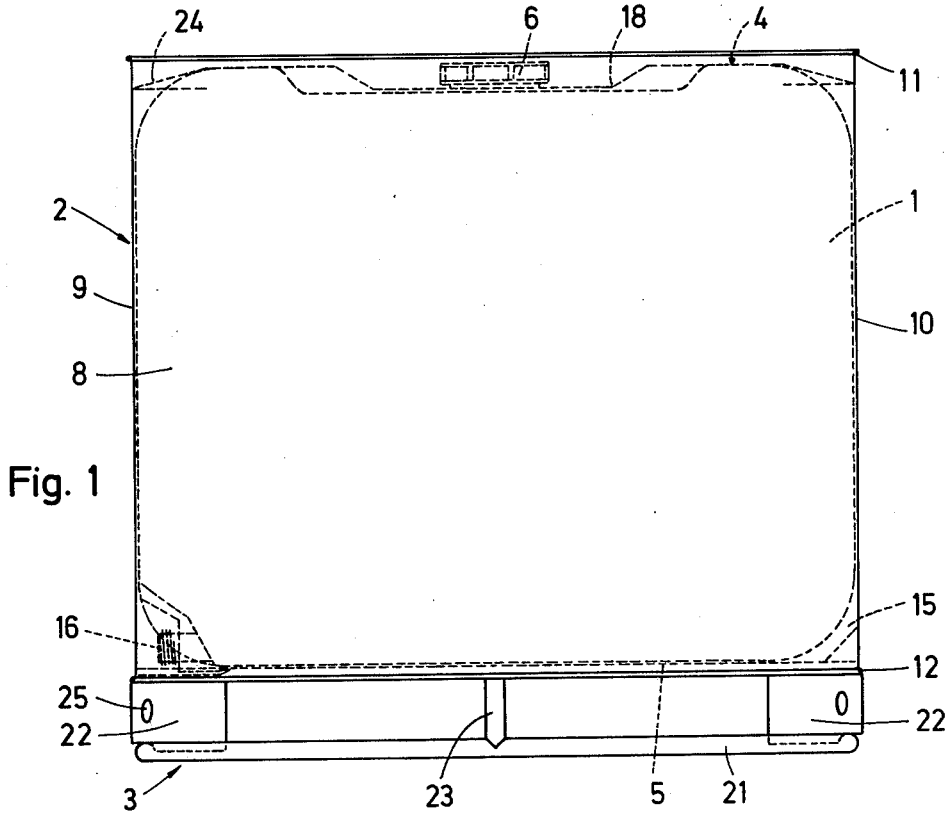

The invention relates to pallet containers consisting of an inner container of a synthetic resin, e.g. polyethylene (PE), an outer shell closely hugging the inner container, and a pallet on which the outer shell is mounted.

Such pallet containers serve for shipping liquids and can be stacked. Since they are mounted on pallets, they can, with the aid of a forklift truck, be brought to the location of their final usage, or they can be loaded, and stacked during this process.

It is an object of the invention to provide a pallet container which remains securely stacked even during transport and which is also secured against shifting during the maneuvering of the pallet containers.

It is furthermore an object of this invention to provide a pallet container, the outer shell of which is produced from sheet metal in such a way that it can carry by itself without additional supports the weight of two filled pallet containers stacked on top thereof, without buckling of the sheet-metal shell.

According to the invention, a pallet container consists of an inner container of a synthetic resin, e.g. polyethylene (PE), which is supported with its lower, rounded edges on a correspondingly profiled ring of foam material (for example of polystyrene or "Styropor"); an outer shell of sheet metal with a bottom and with a lid as well as with recesses to obtain access to a filling port and a discharge port, wherein the sidewalls of the sheet-metal shell are prestretched, with the consequence that the rounded corners of the sheet-metal shell form supporting columns for stacked pallet containers and have a tendency of bending inwardly toward the synthetic resin container during the application of a stacking load, rather than outwardly; and a steel-tube pallet welded to the sheet-metal shell with a lower tubular frame and an upper tubular frame, which are welded into a rigid structure (pallet) at the four corners by way of profiled metal plates and in the middle of their straight lengths by way of small supporting tubes.

Figure 2:
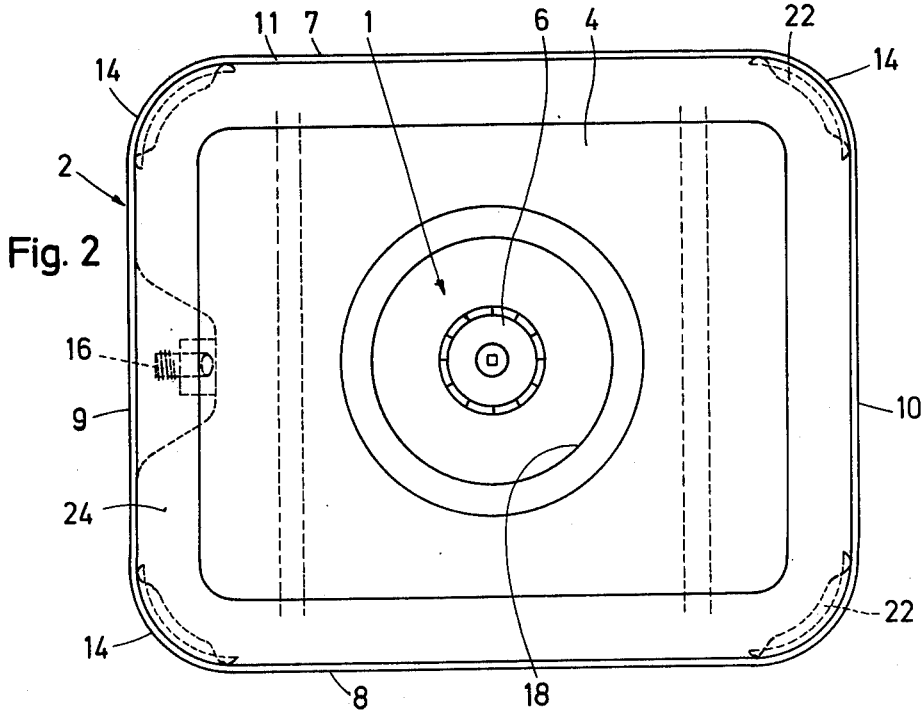
Figure 3:
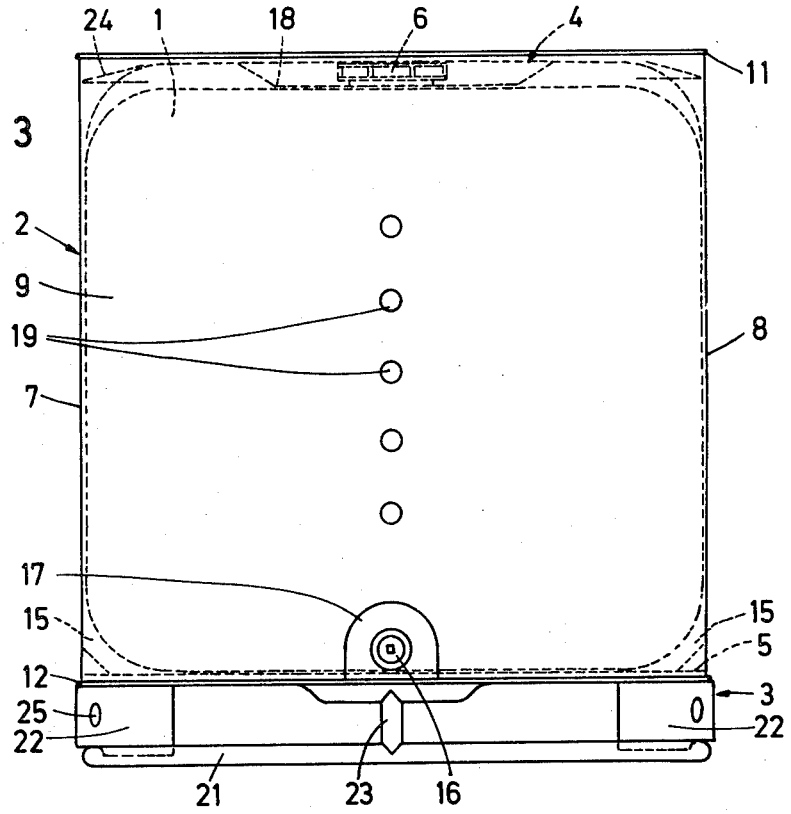
Figure 5:
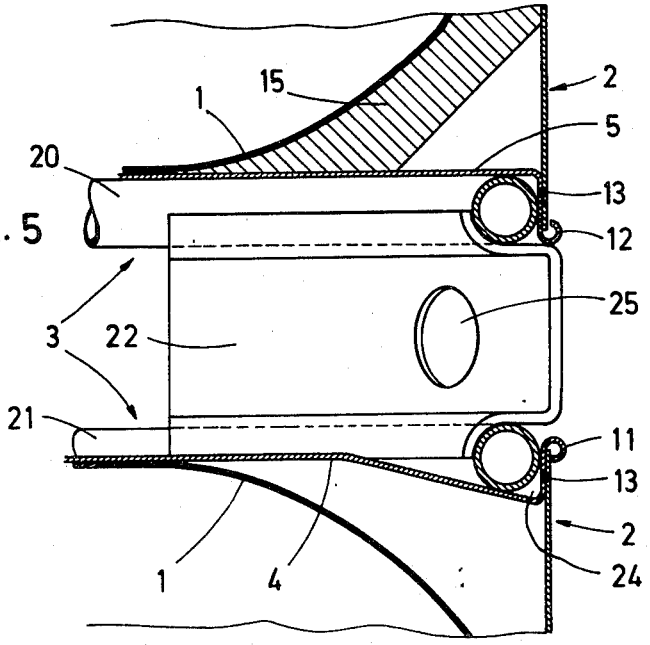
Figure 4:
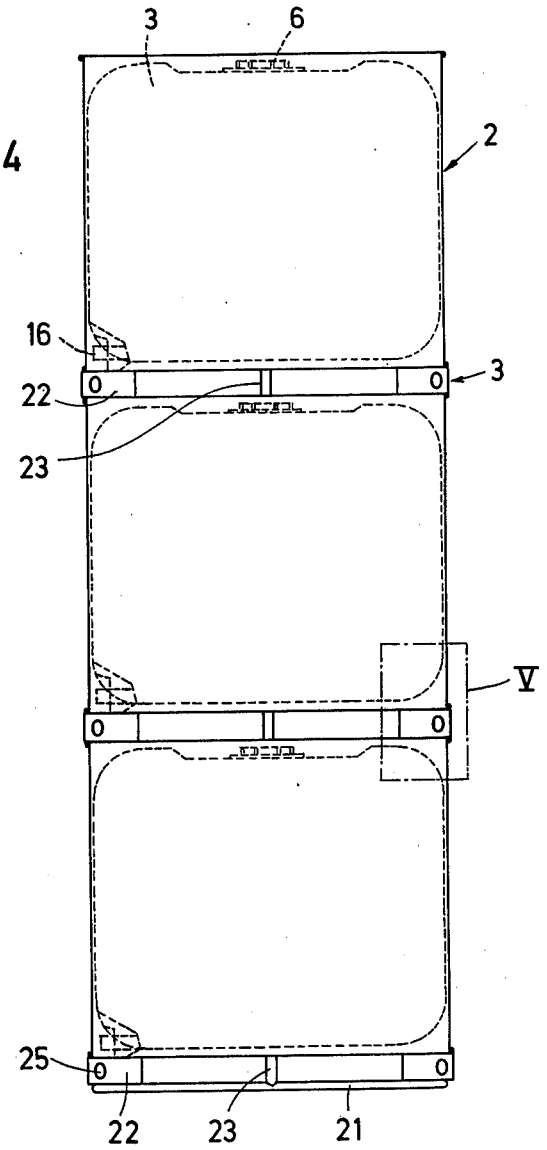

One embodiment of the invention is shown in the drawings, to wit:

FIG. 1 shows a lateral view of a pallet container according to this invention, FIG. 2 shows a top view, FIG. 3 shows a frontal view, FIG. 4 shows a stack of three pallet containers, and FIG. 5 shows a detail V from FIG. 4.

The pallet container consists of an inner container 1 made from a synthetic resin (PE) by the blow-molding technique, an outer shell 2 made of sheet metal, which is in close contact with the inner container 1, and a pallet 3.

The outer shell 2 furthermore comprises a lid 4 and a bottom 5. The lid 4 has a recess 18 in its center, affording free access to a sealable filling opening. The two large sidewalls 7 and 8 and the two small sidewalls 9 and 10 are stretched during the manufacture of the outer shell 2 before the inner container 1 is inserted and before the lid 4 and bottom 5 are welded along their entire periphery to the upper rim 11 and the lower rim 12 of the outer shell 2 (see also FIG. 5). The weld seam is indicated at 13 in FIG. 5. Due to the stretching of the sidewalls 7–10 of the outer shell 2, the structure of the sheet material becomes of such a character that the rounded corners 14 of the outer shell, which consists of galvanized steel sheet, form columns capable of bearing the load of the pallet containers with contents stacked on top thereof. Experiments have shown that a stacking of three pallet containers is not safely possible with the use of unstretched sheet metal. The stretched outer shell 2 is manufactured in accordance with the process described and claimed in U.S. patent application Ser. No. 827,312 of Aug. 24, 1977.

Inner synthetic-resin container 1 is supported at the bottom by a correspondingly shaped supporting ring 15 made of expanded polystyrene (e.g. "Styropor"). This ring is interrupted only in the zone of an outlet opening 16 of the inner container 1. The connecting pipe of the outlet opening 16 can be sealed by an outlet nipple closure as described and claimed in U.S. patent application Ser. No. 796,186 of May 12, 1977. In the zone of the outlet opening 16, the sidewall 9 of the outer shell 2 has a recess 17, just as the lid 4 has the above-mentioned recess 18 in the zone of the filling opening 6. Furthermore, several superposed peepholes 19 are provided in the sidewall 9 for controlling the filling level of the inner container 1.

The pallet 3 comprises an upper tubular steel frame 20 (FIG. 5) and a lower tubular steel frame 21. These tubular steel frames 20, 21 are welded together in the corner zones of the pallet 3 via profiled metal plates 22 and in the middle of the straight lengths of tubes by way of short supporting tubes 23. The pallet 3 can be seized by a forklift truck from all four sides and stacked as shown in FIG. 4. In general, stacking of respectively up to three pallet containers is possible. With a capacity of 1,000 liters of an individual pallet container, a total stacking height of less than 3.5 meters results when stacking three containers. It can clearly be seen that the stacks can be placed in close juxtaposition to one another, so that an optimum utilization of loading space is possible.

As can be seen from FIG. 5, the lower tubular steel frame 21 engages respectively a rim indentation 24 of the lid 4 and is surrounded flush by the upper rim 11 of the outer shell 2, so that shifting of the pallet containers within a stack is impossible. Thus, the stacks are secure during transportation and maneuvering. Holes 25 in the profiled metal plates 22 of the pallets 3 provide during transportation an additional securing of several stacks which can be tied to one another by means of ropes or lines (not illustrated) pulled through the holes 25.

I claim:

1. Pallet container for the transport of liquids, comprising an inner container of synthetic resin, an outer shell of sheet metal with a bottom and a lid, said shell having recesses to provide access to filling and outlet openings of said container, a steel tube pallet welded to the underside of the sheet metal shell, said pallet comprising a lower tubular steel frame and an upper tubular steel frame which are welded into a rigid structure at four corners by profiled metal plates, and a profiled ring of foamed plastic material inside said sheet metal shell and supporting the lower corners of said inner container to impart to said inner corners a smoothly rounded configuration.

2. Pallet container as claimed in claim 1, and short lengths of small supporting tubes welded to and interconnecting the upper and lower tubular steel frames of said pallet intermediate said four corners.

3. Pallet container as claimed in claim 1, said sheet metal shell having downwardly extending rims that extend below said bottom and that surround said upper tubular frame of the pallet.

4. Pallet container as claimed in claim 3, said upper tubular frame being in contact both with said bottom and with said rims.

5. Pallet container as claimed in claim 1, said lid having an upwardly projecting rim in which said lower tubular frame of the pallet fits.

6. Pallet container as claimed in claim 1, said outer shell of sheet metal being generally rectangular with rounded corners as viewed from above and having four sides between said rounded corners which are prestretched, whereby the rounded corners of the sheet metal shell form supporting columns for stacked pallet containers.

7. Pallet container for the transport of liquids, comprising an inner container of synthetic resin, an outer shell of sheet metal with a bottom and a lid, said shell having recesses to provide access to filling and outlet openings of said container, and a steel tube pallet welded to the underside of the sheet metal shell, said pallet comprising a lower tubular steel frame and an upper tubular steel frame which are welded into a rigid structure at four corners by profiled metal plates, said profiled metal plates at the corners of the pallet each comprising an inwardly concave vertical web having upper and lower flanges that extend horizontally inwardly and then upwardly in the case of the upper flange and downwardly in the case of the lower flange, whereby said upper flange contacts the lower and inner sides of the corners of said upper tubular steel frame and said lower flange contacts the upper and inner surfaces of said lower tubular steel frame.

* * * * *